US011263900B2

(12) United States Patent
Sakakibara

(10) Patent No.: US 11,263,900 B2
(45) Date of Patent: Mar. 1, 2022

(54) TRAFFIC INDEX COMPUTATION DEVICE, COMPUTATION METHOD, TRAFFIC SIGNAL CONTROL SYSTEM, AND COMPUTER PROGRAM

(71) Applicant: SUMITOMO ELECTRIC SYSTEM SOLUTIONS CO., LTD., Tokyo (JP)

(72) Inventor: Hajime Sakakibara, Tokyo (JP)

(73) Assignee: SUMITOMO ELECTRIC SYSTEM SOLUTIONS CO., LTD., Tokyo (JP)

( * ) Notice: Subject to any disclaimer, the term of this patent is extended or adjusted under 35 U.S.C. 154(b) by 0 days.

(21) Appl. No.: 17/270,291

(22) PCT Filed: Sep. 4, 2019

(86) PCT No.: PCT/JP2019/034737
§ 371 (c)(1),
(2) Date: Feb. 22, 2021

(87) PCT Pub. No.: WO2020/071040
PCT Pub. Date: Apr. 9, 2020

(65) Prior Publication Data

US 2021/0174672 A1 Jun. 10, 2021

(30) Foreign Application Priority Data

Oct. 5, 2018 (JP) ..... JP2018-190437

(51) Int. Cl.
*G08G 1/08* (2006.01)
*G08G 1/01* (2006.01)
*G08G 1/065* (2006.01)

(52) U.S. Cl.
CPC ..... *G08G 1/08* (2013.01); *G08G 1/0133* (2013.01); *G08G 1/0145* (2013.01); *G08G 1/065* (2013.01)

(58) Field of Classification Search
USPC ..... 340/909–911, 917–922
See application file for complete search history.

(56) References Cited

U.S. PATENT DOCUMENTS

2018/0174449 A1* 6/2018 Nguyen ..... G08G 1/0104
2018/0292224 A1* 10/2018 Brodski ..... G08G 1/0145

FOREIGN PATENT DOCUMENTS

JP 2011-237921 A 11/2011
JP 2017-016554 A 1/2017
WO 2016/147350 A1 9/2016

OTHER PUBLICATIONS

Hisai, Mamoru; "Traffic Flow Control System of Urban Road Networks;" Journal of the Society of Instrument and Control Engineers; 2002; pp. 193-198; vol. 41, No. 3.

(Continued)

*Primary Examiner* — Joseph H Feild
*Assistant Examiner* — Sharmin Akhter
(74) *Attorney, Agent, or Firm* — Oliff PLC

(57) ABSTRACT

A device for calculating a traffic index that is required for calculation of a signal control parameter. The device includes: a first calculation unit that calculates normalized data representing a ratio of a traffic variable of an inflow road at a target intersection to a saturation flow rate; and a second calculation unit that calculates, by using the normalized data, the traffic index that is defined by a formula in which the traffic variable of the inflow road is included in a numerator and the saturation flow rate is included in a denominator.

10 Claims, 11 Drawing Sheets

(56) References Cited

OTHER PUBLICATIONS

Dec. 10, 2019 Written Opinion of the International Searching Authority issued in International Patent Application No. PCT/JP2019/034737.

* cited by examiner

NORMALIZED DATA CALCULATION METHOD (STAND-ALONE INTERSECTION)

If $d_{av} \leqq R/2$ (UNSATURATED)

$$V_{in} = \{1 - R^2 / (2 d_{av} C)\} S_f \quad \cdots\cdots (10)$$

If $R/2 < d_{av}$ (OVER SATURATED)

$$V_{in} = (1 - R/C) S_f$$

$$Q_{in} = \{(d_{av} - R/2)/R\} (1 - R/C) S_f \quad \cdots\cdots (11)$$

$$d_{av} = T_t - \{L / (V_e / 3.6)\} \quad \cdots\cdots (12)$$

$G_c = V_{in} R / (S_f - V_{in})$ ·····(13)
STOP LINE PASSING TIME OF TAIL-END VEHICLE $D = 0.5\{(R+G_c)RV_{in}\}$ ·····(14)
TOTAL DELAY TIME PER CYCLE $d_{av} = D/(CV_{in}) = 0.5\{(R+G_c)R\}/C$ ·····(15)
DELAY TIME PER VEHICLE

If $d_{av} \leqq R/2$ (UNSATURATED) $V_{in} = \{1 - R^2/(2d_{av}C)\}S_f$ ·····(10)

FIG. 8

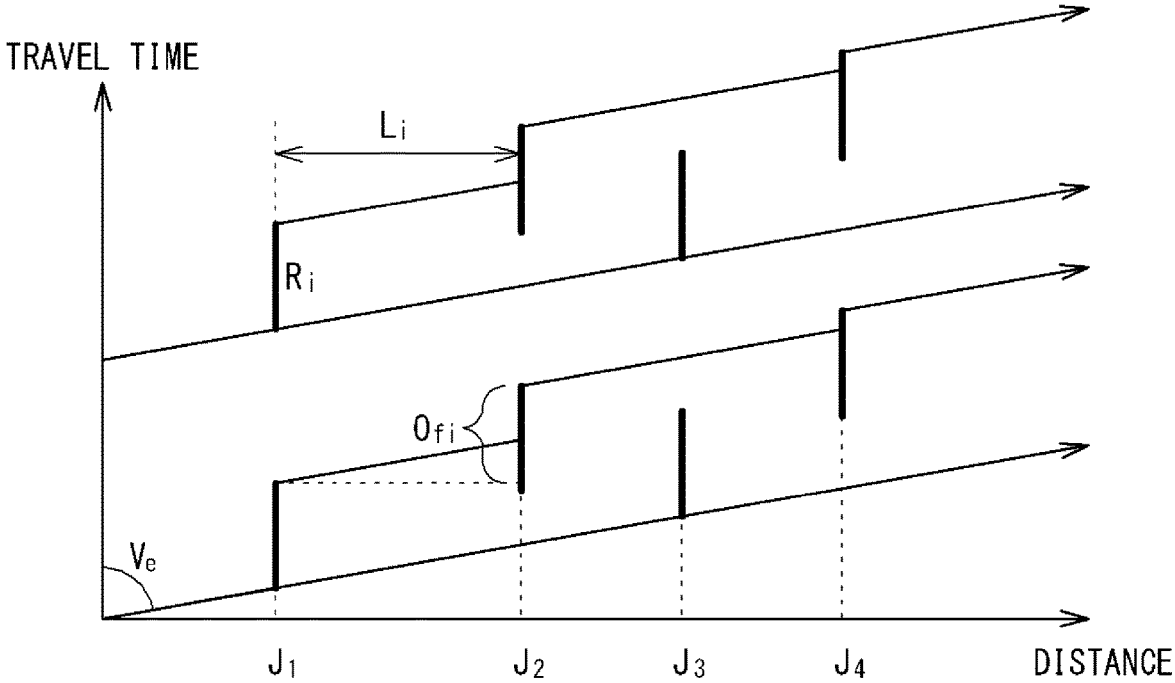

TRAFFIC SIMULATOR 15

CORRESPONDENCE TABLE 16

NORMALIZED DATA CALCULATION METHOD (COORDINATED INTERSECTIONS)

If $d_{av} \leqq d_{sat}$ (UNSATURATED)

| $V_{in}$ | $0.1S_f$ | $0.2S_f$ | $0.3S_f$ | $0.4S_f$ |
|---|---|---|---|---|
| $d_{av}$ | ・・・ | 57.6 | 90.5 | 137.5 |

* PITCH OF $V_{in}$ IS OPTIONAL

* INTERMEDIATE VALUE (E.G., $0.35S_f$:114 SECONDS) IN THE TABLE IS OBTAINED BY LINEAR INTERPOLATION, FOR EXAMPLE

If $d_{sat} < d_{av}$ (OVER SATURATED)

$$V_{in} = (1-R/C)S_f$$

$$Q_{in} = \{(d_{av} - d_{sat})/R\}(1-R/C)S_f \quad \cdots\cdots (16)$$

FIG. 10

TRAFFIC DEMAND ESTIMATION FORMULA IN UNSATURATED STATE $D_m = V_{in}/C = \{1 - R^2/(2d_{av}C)\} S_f/C$ ·····(17)

DIVIDE ARRIVAL TRAFFIC VOLUME BY CYCLE LENGTH C

TRAFFIC DEMAND ESTIMATION FORMULA IN OVER SATURATED STATE $D_m = \{Q_{in(t)} - Q_{in(t-1)} + (1-R/C) S_f\}/C$ ·····(18)

ADD NUMBER OF OUTFLOW VEHICLES IN PRESENT CYCLE, TO DIFFERENCE BETWEEN NUMBER OF QUEUING VEHICLES IN PREVIOUS CYCLE AND THAT IN PRESENT CYCLE, AND DIVIDE RESULTANT BY C

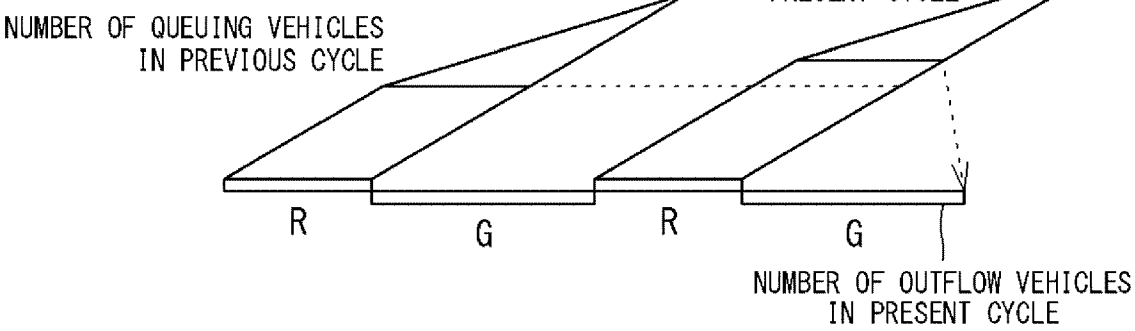

FIG. 11

SATURATION STATE DETERMINATION METHOD CONSIDERING RANGE OF ERROR IN DELAY TIME

| | |
|---|---|
| $d_{av}+e \leqq R/2$ | HIGHLY LIKELY TO BE UNSATURATED |
| $d_{av} \leqq R/2 < d_{av}+e$ | LIKELY TO BE OVER SATURATED |
| $R/2 < d_{av}$ | OVER SATURATED |

TRAFFIC VOLUME ESTIMATED FROM PROBE INFORMATION INCLUDING ERROR

If $d_{av}+e \leqq R/2$ (UNSATURATED)

$$V_{in}=\{1-R^2/(2(d_{av}+e)C)\}S_f$$

If $R/2 < d_{av}+e$ (DOUBTABLE OVER-SATURATED)

$$V_{in}=(1-R/C)S_f$$

$$Q_{in}=\{((d_{av}+e)-R/2)/R\}(1-R/C)S_f$$

TRAFFIC INDEX COMPUTATION DEVICE, COMPUTATION METHOD, TRAFFIC SIGNAL CONTROL SYSTEM, AND COMPUTER PROGRAM

TECHNICAL FIELD

The present invention relates to a traffic index calculation device, a traffic index calculation method, a traffic signal control system, and a computer program.

This application claims priority on Japanese Patent Application No. 2018-190437 filed on Oct. 5, 2018, the entire content of which is incorporated herein by reference.

BACKGROUND ART

MODERATO, SCOOT, SCATS, etc., have been known as methods of remote control performed by a central apparatus of a traffic control center.

Among these methods, MODERATO is employed in Japan. MODERATO is a system for automatically generating signal control parameters such as a split and a cycle length, based on a load ratio (=(inflow traffic volume+number of queuing vehicles)/saturation flow rate) for each inflow road at an intersection (refer to PATENT LITERATURE 1).

CITATION LIST

Patent Literature

PATENT LITERATURE 1: International Publication WO2016/147350

SUMMARY OF INVENTION (1) A device according to one aspect of the present disclosure is a device configured to calculate a traffic index that is required for calculation of a signal control parameter. The device includes: a first calculation unit configured to calculate normalized data representing a ratio of a traffic variable of an inflow road at a target intersection to a saturation flow rate; and a second calculation unit configured to calculate, by using the normalized data, the traffic index that is defined by a formula in which the traffic variable of the inflow road is included in a numerator and the saturation flow rate is included in a denominator.

(9) A traffic signal control system according to an aspect of the present disclosure includes: the aforementioned calculation device; and a central apparatus configured to perform remote control for causing a traffic signal controller at the target intersection to operate according to the signal control parameter obtained from the traffic index.

(10) A method according to an aspect of the present disclosure is a method for calculating a traffic index that is required for calculation of a signal control parameter. The method includes: a first step of calculating normalized data representing a ratio of a traffic variable of an inflow road at a target intersection to a saturation flow rate; and a second step of calculating, by using the normalized data, the traffic index that is defined by a formula in which the traffic variable of the inflow road is included in a numerator and the saturation flow rate is included in a denominator.

(11) A program according to an aspect of the present disclosure is a computer program for causing a computer to function as a device for calculating a traffic index that is required for calculation of a signal control parameter. The computer program causes the computer to function as: a first calculation unit configured to calculate normalized data representing a ratio of a traffic variable of an inflow road at a target intersection to a saturation flow rate; and a second calculation unit configured to calculate, by using the normalized data, the traffic index that is defined by a formula in which the traffic variable of the inflow road is included in a numerator and the saturation flow rate is included in a denominator.

BRIEF DESCRIPTION OF DRAWINGS

FIG. 8 illustrates an example of a normalized data calculation method in a case where a target intersection subjected to remote control is a coordinated intersection.

FIG. 10 illustrates an example of a method for estimating normalized traffic demand Dm.

FIG. 11 illustrates a saturation state determination method considering an error in delay time, and an example of a traffic volume calculation formula.

DESCRIPTION OF EMBODIMENTS

Figure 1:
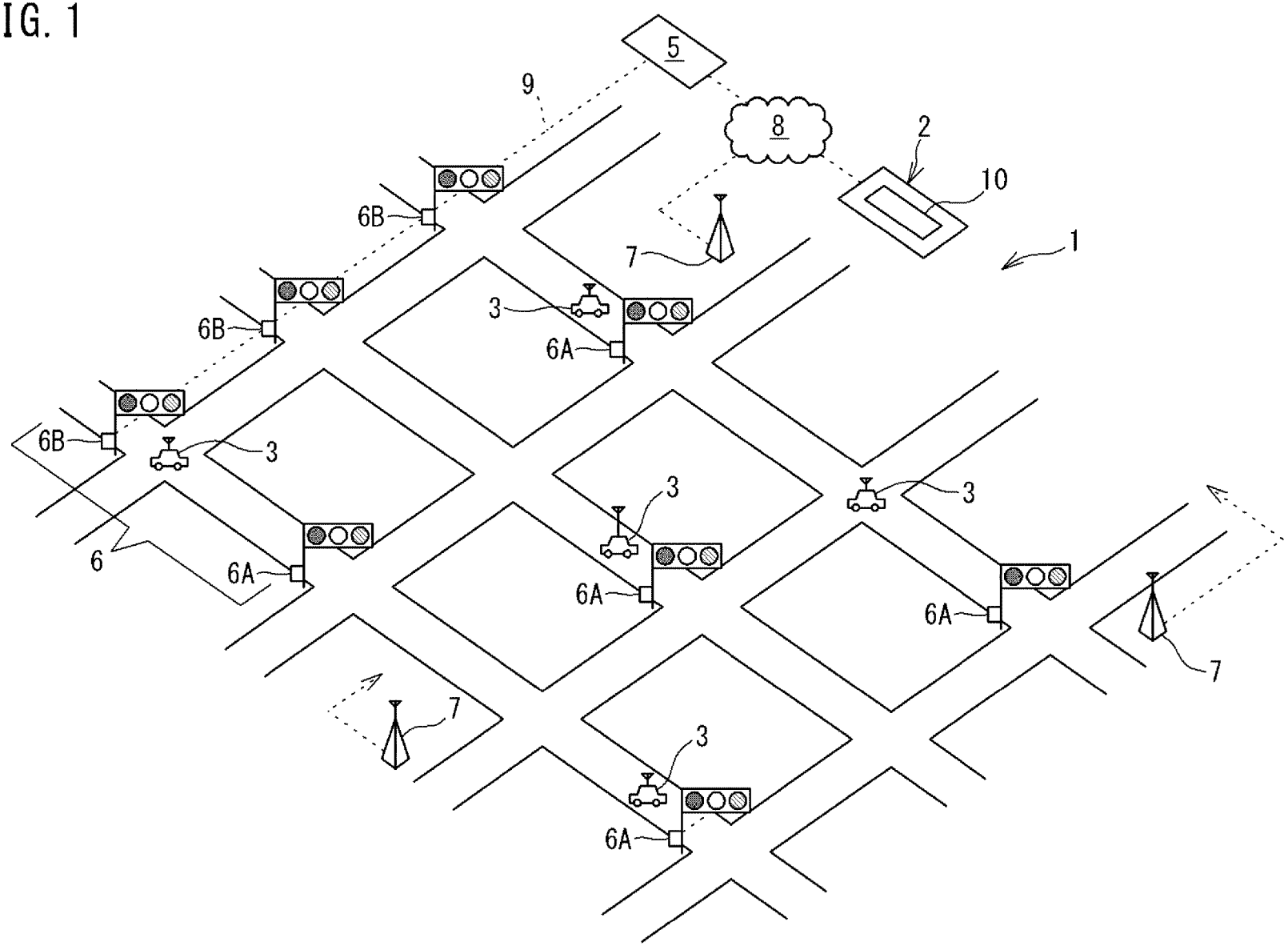
FIG. 1 shows an overall configuration of a traffic signal control system.

<Problems to be Solved by the Present Disclosure>

The traffic volume and the number of queuing vehicles on an inflow road are usually measured based on a detection signal from a vehicle detector installed on the inflow road. Therefore, remote control such as MODERATO is not executed at an intersection where a vehicle detector is not installed on an inflow road.

However, under the present situation in Japan, two thirds (⅔) of all intersections do not have vehicle detectors installed therein. There are also some countries that do not have vehicle detectors installed at a higher rate than this. Therefore, it is desired to realize remote control even for an intersection where a vehicle detector is not installed.

The present disclosure has been made to solve the above problems and an object of the present disclosure is to realize remote control even for an intersection where a vehicle detector is not installed.

<Effects of the Present Disclosure>

According to the present disclosure, it is possible to realize remote control even for an intersection where a vehicle detector is not installed.

<Outline of Embodiment of the Present Disclosure>

Hereinafter, the outline of an embodiment of the present disclosure is listed and described.

(1) A device according to the present embodiment is a device configured to calculate a traffic index that is required for calculation of a signal control parameter. The device includes: a first calculation unit configured to calculate normalized data representing a ratio of a traffic variable of an inflow road at a target intersection to a saturation flow rate; and a second calculation unit configured to calculate, by using the normalized data, the traffic index that is defined by a formula in which the traffic variable of the inflow road is included in a numerator and the saturation flow rate is included in a denominator.

According to the calculation device of the present embodiment, the first calculation unit calculates the normalized data representing the ratio of the traffic variable of the inflow road at the target intersection to the saturation flow rate, and the second calculation unit calculates, by using the normalized data, the traffic index that is defined by the formula in which the traffic variable of the inflow road is included in the numerator and the saturation flow rate is included in the denominator. Therefore, it is possible to calculate the traffic index by using the normalized data that can be estimated from probe information or the like.

Consequently, calculating the signal control parameter by using the traffic index based on the normalized data enables execution of remote control even for an intersection where a vehicle detector is not installed.

(2) In the calculation device of the present embodiment, the first calculation unit preferably calculates the normalized data by using a delay time, caused by waiting at a traffic signal, obtained from probe information of a vehicle.

(3) Furthermore, the first calculation unit preferably calculates the normalized data by using the delay time, and a cycle length and a red interval at the target intersection.

With the above configuration, since the normalized data is calculated with the probe information and the signal information being original data, calculation of the normalized data can be executed even without a detection signal from a vehicle detector.

(4) Specifically, in the calculation device of the present embodiment, when the target intersection is a stand-alone intersection and the inflow road is in an unsaturated state, the first calculation unit preferably calculates a normalized traffic volume representing a ratio of the traffic volume on the inflow road to the saturation flow rate, by using a delay time per vehicle, due to waiting at the traffic signal, obtained from an average travel time of probe vehicles, and a cycle length and a red interval at the stand-alone intersection.

With this configuration, the normalized traffic volume can be calculated with the probe information and the signal information being original data.

(5) In the calculation device of the present embodiment, when the target intersection is a stand-alone intersection and the inflow road is in an over saturated state, the first calculation unit preferably calculates the normalized traffic volume, and a normalized number of queuing vehicles that represents a ratio of the number of queuing vehicles on the inflow road to the saturation flow rate, by using a delay time per vehicle, due to waiting at the traffic signal, obtained from the average travel time of probe vehicles, and the cycle length and the red interval at the stand-alone intersection.

With this configuration, the normalized traffic volume and the normalized number of queuing vehicles can be calculated with the probe information and the signal information being original data.

(6) In the calculation device of the present embodiment, when the target intersection is a coordinated intersection, the first calculation unit preferably calculates the normalized traffic volume for each of intersections included in a coordinated section, by further using a result of simulation, for a traffic flow in the coordinated section, executed by a traffic simulator.

With this configuration, the normalized traffic volume can be accurately calculated even for the coordinated intersection where the behavior of vehicles on the inflow road is difficult to be modeled.

(7) In the calculation device of the present embodiment, when the inflow road at the target intersection is in an over saturated state, the first calculation unit preferably calculates the normalized traffic volume, and the normalized number of queuing vehicles that represents the ratio of the number of queuing vehicles on the inflow road to the saturation flow rate, by using a threshold value obtained from the result of the simulation with respect to the delay time, and the cycle length and the red interval at the target intersection.

With this configuration, the normalized traffic volume and the normalized number of queuing vehicles can be calculated with the simulation result and the signal information being original data.

(8) In the calculation device of the present embodiment, the traffic variable of the inflow road is preferably an inflow traffic volume and a number of queuing vehicles on the inflow road, or the inflow traffic volume on the inflow road.

The reason is as follows. In a definition formula for "load ratio" which is a kind of traffic index required for calculation of a signal control parameter, an inflow traffic volume and a number of queuing vehicles are included in a numerator while a saturation flow rate is included in a denominator. In addition, in a definition formula for "phase saturation" which is another traffic index required for calculation of a signal control parameter, an inflow traffic volume is included in a numerator while a saturation flow rate is included in a denominator.

(9) A traffic signal control system of the present embodiment includes the calculation device according to any of the above (1) to (8), and a central apparatus configured to perform remote control for causing a traffic signal controller at the target intersection to operate according to the signal control parameter obtained from the traffic index.

According to the traffic signal control system of the present embodiment, the central apparatus causes the traffic signal controller at the target intersection to operate according to the signal control parameter obtained from the traffic index calculated by the calculation device. Therefore, the traffic signal controller can be remotely controlled even when no vehicle detector is installed.

(10) A calculation method of the present embodiment is a determination method executed by the calculation device according to any of the above (1) to (8). Therefore, the calculation method of the present embodiment exhibits the same operational effect as those of the calculation device according to the above (1) to (8).

(11) A computer program of the present embodiment is a computer program for causing a computer to function as the calculation device according to any of the above (1) to (8). Therefore, the computer program of the present embodiment exhibits the same operational effect as those of the calculation device according to the above (1) to (8).

<Details of Embodiment of the Present Disclosure>

Hereinafter, an embodiment of the present disclosure will be described in detail with reference to the drawings. At least some parts of the embodiment described below can be combined together as desired.

Definition of Terms

In advance of describing the present embodiment in detail, terms used in this specification are defined as follows.

"Vehicle": General vehicles traveling on roads. Therefore, not only automobiles, light automobiles, and trolleybuses, but also motorcycles can be vehicles.

In this embodiment, a reference to "vehicle" includes both a probe vehicle having an on-vehicle device capable of transmitting probe information, and an ordinary vehicle having no such on-vehicle device.

"Probe information": Various information, related to a probe vehicle, sensed by the probe vehicle traveling on a road. The probe information is also referred to as probe data or floating car data. The probe information includes various vehicle data such as identification information, a vehicle position, a vehicle speed, and a vehicle heading of the probe vehicle, and generation times thereof. As for the probe information, information such as a position and an acceleration acquired by a smartphone, a tablet, etc., in the vehicle may be used.

"Probe vehicle": A vehicle that senses probe information and transmits the probe information to the outside. Vehicles traveling on roads include probe vehicles and vehicles other than the probe vehicles. However, even an ordinary vehicle having no on-vehicle device capable of transmitting probe information is also regarded as a probe vehicle if the vehicle has a smartphone, a tablet PC, etc., capable of transmitting, to the outside, probe information such as positional information of the vehicle.

"Signal control parameter": A cycle length, a split, and an offset that are temporal elements regarding traffic signal indication are collectively referred to as signal control parameters or signal control constants.

"Cycle length": A time period of one cycle from green (or red) start time to next green (or red) start time of a traffic signal unit. In Japan, it is determined by law to refer to green light as "blue".

"Split": A ratio of a time length assigned to each phase to a cycle length. Generally, a split is expressed by a percentage or a ratio. Strictly, a split is a value obtained by dividing an effective green interval by a cycle length.

"Offset": In coordinated control or wide-area control, an offset is a deviation of a certain time point of signal indication, e.g., a starting time point of major-road green light, from a reference time point common to a group of traffic signal units, or a deviation in the same signal indication starting time point between adjacent intersections. The former is referred to as an absolute offset and the latter is referred to as a relative offset, each being represented by a percentage of time (seconds) or cycle.

"Green interval": A time slot during which vehicles have right of way at an intersection. A green interval ending time point may be set to a green light extinction time point at the earliest, or to a yellow light extinction time point at the latest. In the case of an intersection having an arrow light, a green interval ending time point may be a right-turn arrow ending time point.

"Red interval": A time slot during which vehicles do not have right of way at an intersection. A red interval starting time point may be set to a green light extinction time point at the earliest, or to a yellow light extinction time point at the latest. In the case of an intersection having an arrow light, a red interval starting time point may be a right-turn arrow ending time point.

As described above, in the present embodiment, time slots included in one cycle are roughly classified into a green interval in which vehicles have right of way and a red interval in which vehicles have no right of way. Therefore, assuming that the green interval is G, the red interval is R, and the cycle length is C, a relationship of $C=G+R$ is satisfied.

Therefore, as for a calculation formula including R (e.g., formula (10) and formula (11) described later), $(C-G)$ may be used instead of R. That is, the red interval R in the present embodiment may be a value indirectly calculated from the cycle length C and the green interval G.

"Queue": A queue of vehicles that are stopped upstream of an intersection and wait for a signal light to change from red, for example.

"Link": A road section having an upstream or downstream direction and connecting nodes such as intersections. When viewed from a certain intersection, a link in a direction that flows in toward this intersection is referred to as an inflow link, and a link in a direction that flows out from this intersection is referred to as an outflow link.

"Travel time": A time period that a vehicle requires for traveling a certain section. A travel time includes a stop time period and a delay time period during the traveling.

"Link travel time": A travel time in a case where a road section as a travel time calculation unit is a "link", that is, a travel time that a vehicle requires for traveling from a starting end to a terminal end of one link.

"Traffic capacity": A traffic capacity of a road is the maximum number of vehicles that can safely pass a predetermined section of one lane or a road in one direction within a predetermined time period, under road conditions such as the shape, the width, and the gradient of the road, and traffic conditions such as the vehicle model types and the speed limit. In a case of a road having two lanes or three lanes, the traffic capacity of the road is obtained from both or all the lanes.

"Traffic volume": The number of passing vehicles per unit time. Unless otherwise noted, a traffic volume indicates the number of passing vehicles per hour. However, for control or evaluation, a traffic volume per shorter unit time such as seconds, 5 minutes, 15 minutes, etc., may be used. Generally, a traffic volume increases with an increase in traffic demand, but decreases when the traffic demand exceeds the traffic capacity.

"Load ratio": In an over saturated state, a "loaded traffic volume" needs to be considered as a control target variable. The loaded traffic volume is obtained by adding the number of queuing vehicles that cannot pass a stop line, to a traffic volume having passed the stop line.

A ratio of a loaded traffic volume (flow rate) per unit time to a saturation flow rate is referred to as a load ratio. When the number of vehicles that cannot pass a stop line due to the over saturated state is small, the load ratio is equivalent to a flow ratio.

"Traffic demand": A traffic volume or a flow rate that reaches a stop line of an inflow road within a predetermined time period, with respect to a certain intersection or each inflow road, or a traffic direction.

"Flow rate": A value obtained by converting the number of vehicles passing a certain cross section of a lane or a road during a certain time period (usually, less than 1 hour) into per unit time (usually, 1 hour).

For example, when the traffic volume for 15 minutes is 90 vehicles, the flow rate for 15 minutes is 360 (vehicles/hour) or 6 (vehicles/minute). The flow rate is a reciprocal of an average headway of vehicles having passed during a certain time period to be targeted.

"Over saturated/unsaturated/nearly saturated": When some queuing vehicles cannot pass a stop line by the end of green light, the traffic demand exceeds the traffic capacity. This state is referred to as an "over saturated state".

Meanwhile, when the traffic demand is equal to or less than the traffic capacity and a queue of vehicles waiting at a traffic signal is cleared away by the end of green light, this state is referred to as an "unsaturated state". A state that is not over saturated but has a high flow ratio (e.g., 0.85 or higher) is referred to as a "nearly saturated state". The flow ratio is less than 1.

"Saturation flow rate": The maximum number of vehicles, which can pass a stop line, per unit time (e.g., 1 second) per lane, in an inflow area of an intersection, while the traffic demand is sufficient.

When the traffic flow line varies, such as when there is a right-turn exclusive lane or a left-turn exclusive lane in addition to a straight through lane, the value of the saturation flow rate varies. The value of the saturation flow rate also varies depending on the road or traffic conditions such as a lane width or a percentage of heavy vehicles.

"Point control": Traffic signal control can be classified into three types, i.e., point control, coordinated control, and wide-area control, in terms of the number of intersections and the spatial arrangement of intersections. Among them, the point control is a method of independently controlling a signalized intersection.

"Coordinated control": A method of controlling a series of adjacent intersections in interlocking with each other. This method is characterized in that a common cycle length (common coordinated cycle length) and an offset are set for a plurality of traffic signal units to be subjected to coordinated control.

"Wide-area control": A method of collectively controlling a large number of traffic signal units installed in an area-wide road network. The wide-area control is the coordinated control expanded in terms of area.

"Fixed-time control": Traffic signal control can be classified into three types, i.e., fixed-time control, traffic actuated control, and traffic adaptive control, in terms of a method for setting signal control parameters.

Among them, the fixed-time control is a method of setting signal control parameters in advance according to time slots. The fixed-time control is executed with one combination being selected from among combinations (programs) of signal control parameters set in advance based on time slots, days of the week (weekday, Saturday, Sunday, and holiday), etc.

"Traffic actuated control": A method executed for each traffic signal controller, among traffic signal controls using vehicle detectors. This control is also referred to as terminal actuated control.

In the traffic actuated control, starting and ending time points of green light are determined in response to a change in traffic demand in a short time. As a result, the length of green interval and the cycle length are changed.

"Traffic adaptive control": A control method in which a central apparatus of a traffic control center changes signal control parameters for, as a control target, a traffic signal controller at an important intersection or traffic signal controllers at a plurality of intersections subjected to coordinated control or wide-area control. Since the central apparatus remotely controls one or a plurality of traffic signal controllers, this control is also referred to as "remote control" in the present embodiment.

The traffic adaptive control enables advanced coordinated control in response to variation in the traffic flow, and therefore is applied to a road where the traffic volume and its variation with time are significant and high traffic handling efficiency is required.

The traffic adaptive control is classified into two types, i.e., "program selection control" and "program formation control". The program selection control is a method of selecting, from among a plurality of combinations (programs) prepared in advance, a combination suitable for the present traffic situation, based on information from a vehicle detector or the like.

The program formation control is a method of, instead of preparing combinations of a finite number of signal control parameters, instantly determining a signal control parameter or a signal light color switching timing, based on information from a vehicle detector or the like.

"MODERATO (Management by Origin-DEstination Related Adaptation for Traffic Optimization)": The name of program formation control employed in UTMS (Universal Traffic Management System) in Japan.

The MORERATO is a system for automatically generating a signal control parameter from a load ratio (=(inflow traffic volume+number of queuing vehicles)/saturation flow rate) for each of inflow roads at an intersection.

"SCOOT (Split Cycle Offset Optimisation Technique)": A method of program formation control developed in the UK. The SCOOT is widely used particularly in European countries.

The SCOOT is a system for, using data from a vehicle detector installed on a road, automatically controlling a signal light color of a traffic signal unit so as to adapt to the present traffic situation in almost real time.

"SCATS (Sydney Coordinated Adaptive Traffic System)": A method of program selection control developed in Australia. The SCATS is employed at about 42,000 intersections in over 1800 cities in almost 40 countries.

The SCATS is a system in which an automatic plan is selected from a library in response to data obtained from a loop detector or the like installed on a road, thereby finding signal control parameters (cycle length, split, and offset) most suitable for the present traffic situation.

[Overall Configuration of System]

FIG. 1 shows an overall configuration of a traffic signal control system 1 according to the present embodiment.

Figure 2:
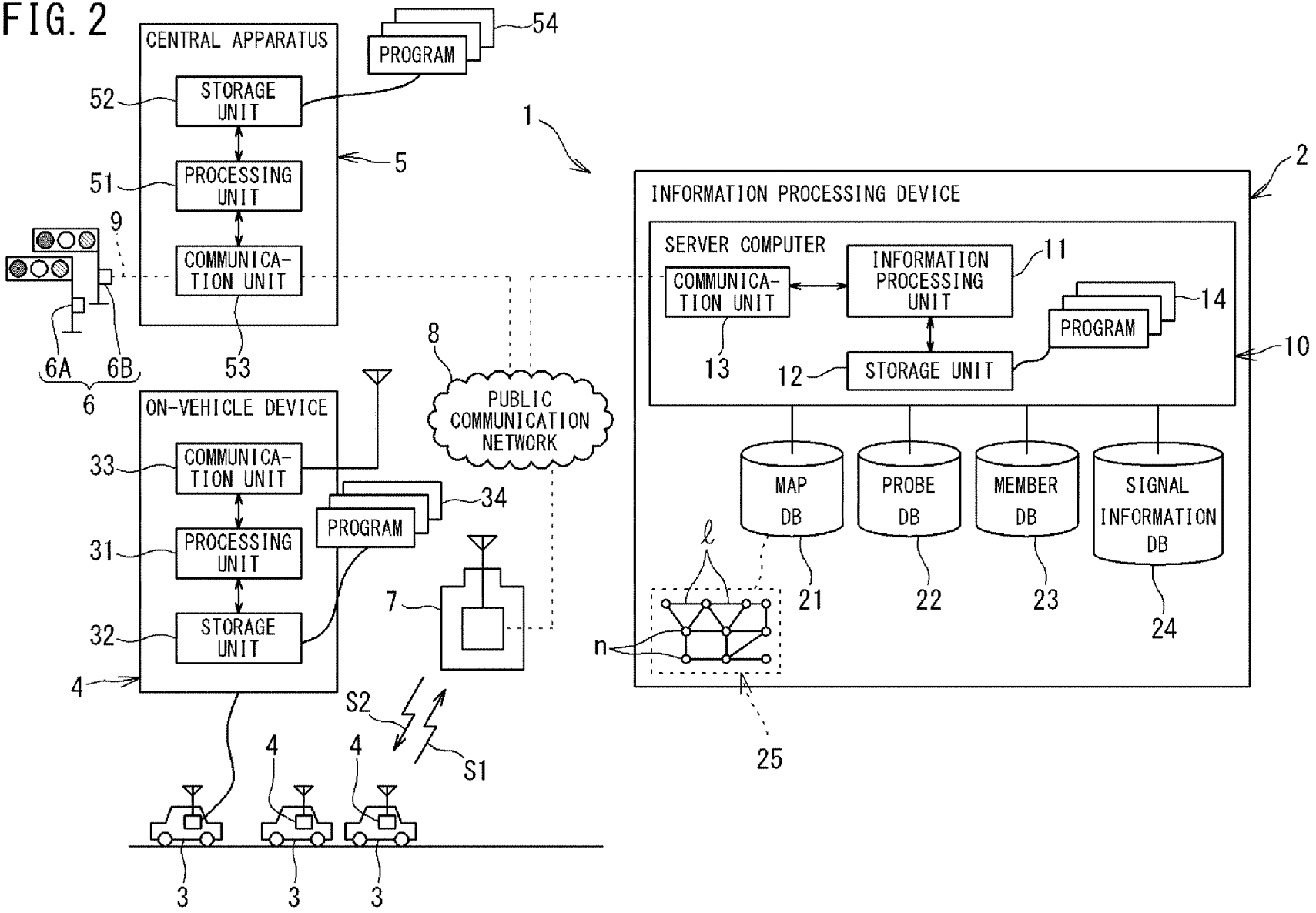
FIG. 2 is a block diagram showing an information processing device, on-vehicle devices of probe vehicles, and a central apparatus included in the traffic signal control system.

FIG. 2 is a block diagram showing an information processing device 2, an on-vehicle device 4 of each probe vehicle 3, and a central apparatus 5 which are included in the traffic signal control system 1.

As shown in FIG. 1 and FIG. 2, the traffic signal control system 1 includes: the information processing device 2 installed in a data center or the like; the on-vehicle devices 4 mounted on the probe vehicles 3; the central apparatus 5 installed in a traffic control center; and traffic signal controllers 6 installed at intersections.

In the traffic signal control system 1 of the present embodiment, the information processing device 2 collects, from each probe vehicle 3, probe information including the vehicle position and the vehicle passing time, and acquires signal information of each intersection from the central apparatus 5. Using the probe information and the signal information, the information processing device 2 calculates a traffic index such as a load ratio required for generating a signal control parameter for the intersection.

Thus, the information processing device 2 of the present embodiment functions as a "traffic index calculation device" required for generating a signal control parameter.

An operation entity of the information processing device 2 is not particularly limited. For example, an operation entity of the information processing device 2 may be a manufacturer of the vehicles 3, an IT company carrying out various information services, or a public entity that is in charge of traffic control and manages the central apparatus 5.

As for operation of a server of the information processing device 2, either an on-premises server or a cloud server may be employed.

The on-vehicle device 4 of each probe vehicle 3 is capable of wirelessly communicating with wireless base stations 7 (e.g., mobile base stations) in various places. Each wireless base station 7 is capable of communicating with the information processing device 2 via a public communication network 8 such as the Internet.

Therefore, each on-vehicle device 4 can wirelessly transmit uplink information S1 addressed to the information processing device 2, to the wireless base station 7. The information processing device 2 can transmit downlink information S2 addressed to a specific on-vehicle device 4, to the public communication network 8.

[Configuration of Information Processing Device]

As shown in FIG. 2, the information processing device 2 includes a server computer 10 implemented by a workstation, and various databases 21 to 24 connected to the server computer 10. The server computer 10 includes a processing unit 11, a storage unit 12, and a communication unit 13.

The storage unit 12 is a storage device including at least one nonvolatile memory (storage medium) of an HDD (Hard Disk Drive) and an SSD (Solid State Drive), and a volatile memory (storage medium) such as a random access memory. The nonvolatile memory may be removable.

The processing unit 11 is implemented by an arithmetic processing device including a CPU (Central Processing Unit) that reads out computer programs 14 stored in the nonvolatile memory of the storage unit 12 and performs information processing according to the programs 14.

The computer programs 14 in the information processing device 2 include, for example, programs that cause the CPU of the processing unit 11 to execute calculation processes for predetermined traffic indices, such as calculation of a delay time caused by a probe vehicle 3 waiting at a traffic signal, calculation of a load ratio based on the delay time, and the like.

The communication unit 13 is implemented by a communication interface that communicates with the central apparatus 5 and the wireless base station 7 via the public communication network 8.

The communication unit 13 is capable of receiving the uplink information S1 transmitted from the wireless base station 7 to the information processing device 2, and transmitting the downlink information S2 generated in the information processing device 2, to the wireless base station 7. The uplink information S1 includes probe information transmitted from the on-vehicle device 4. The downlink information S2 includes, for example, a link travel time calculated by the processing unit 11.

The communication unit 13 is capable of receiving signal information, of an intersection included in a traffic control area, transmitted from the central apparatus 5 to the information processing device 2. The signal information of the intersection includes at least a cycle length and a red interval length at the intersection.

The communication unit 13 may be connected to the central apparatus 5 of the traffic control center via a dedicated communication line 9 instead of the public communication network 8.

Each of the various databases 21 to 24 are implemented by a large-capacity storage including an HDD, an SSD, or the like. These databases 21 to 24 are connected to the server computer 10 such that data can be transferred therebetween.

The databases 21 to 24 include the map database 21, the probe database 22, the member database 23, and the signal information database 24.

Road map data 25 covering the whole country is recorded in the map database 21. The road map data 25 includes "intersection data" and "link data".

The "intersection data" is data in which an intersection ID assigned to a domestic intersection is associated with position information of the intersection. The "link data" consists of data in which the following information 1) to 4) is associated with a link ID of a specific link assigned to a domestic road.

Information 1): position information of start/end/interpolation points of a specific link Information 2): link ID that connects to the start point of the specific link Information 3): link ID that connects to the end point of the specific link Information 4): link cost of the specific link The road map data 25 constitutes a network corresponding to actual road alignment and traveling directions on roads. Therefore, the road map data 25 is a network in which road sections between nodes representing intersections are connected by directed links l (lowercase letter "l").

Specifically, the road map data 25 is composed of a directed graph in which a node n is set for each intersection and nodes n are connected by a pair of directed links l in opposite directions. Therefore, in the case of a one-way road, nodes n are connected only by directed links l in one direction.

The road map data 25 also includes: road type information in which a specific directed link l corresponding to each road on the map represents whether the road is a general road or a toll road; facility information representing the type of a facility such as a parking area or a tollgate included in a directed link l; and the like.

In the probe database 22, probe information received from probe vehicles 3 registered in the information processing device 2 in advance is accumulated for the identification information of each vehicle 3.

The probe information accumulated includes at least the vehicle position and the vehicle passing time. The probe information may include vehicle data such as a vehicle speed, a vehicle heading, and state information (stop/travel event) of the vehicle. A sensing period of the probe information has granularity that allows traveling history of the probe vehicle 3 to be accurately specified. The sensing cycle is 0.5 to 1.0 seconds, for example.

The member database 23 includes personal information such as the address and name of an owner (registered member) of each probe vehicle 3, vehicle identification number (VIN), and identification information of the corresponding on-vehicle device 4 (e.g., at least one of a MAC address, an email address, a telephone number, etc.).

In the signal information database 24, signal information including the cycle length and the red interval length of the inflow road of each intersection is accumulated for each intersection ID and link ID.

The traffic signal controllers 6 installed at the intersections in the traffic control area include two types of traffic signal controllers, i.e., a first controller 6A and a second controller 6B.

First controller 6A: A traffic signal controller that is not subjected to remote control (coordinated control, wide-area control, etc.) of the central apparatus 5, and performs point control (fixed-time control, etc.) of independently determining a signal light color.

Second controller 6B: A traffic signal controller that is subjected to remote control (coordinated control, wide-area control, etc.) of the central apparatus 5.

As for signal information of the first controller 6A, the central apparatus 5 transmits, to the information processing device 2, the signal information only when the operation thereof has been changed. The processing unit 11 updates the signal information of the first controller 6A included in the signal information database 24 to the received signal information.

As for signal information of the second controller 6B, the central apparatus 5 transmits, to the information processing device 2, the signal information in every predetermined control cycle (e.g., 1.0 to 2.5 minutes). The processing unit 11 updates the signal information of the second controller 6B included in the signal information database 24 to the received signal information.

[Configuration of On-Vehicle Device]

As shown in FIG. 2, the on-vehicle device 4 is implemented by a computer device including a processing unit 31, a storage unit 32, a communication unit 33, etc.

The processing unit 31 is implemented by an arithmetic processing device including a CPU that reads out computer programs 34 stored in a nonvolatile memory of the storage unit 32, and performs various kinds of information processing according to the programs 34.

The storage unit 32 is a storage device including at least one nonvolatile memory (storage medium) of an HDD (Hard Disk Drive) and an SSD (Solid State Drive), and a volatile memory (storage medium) such as a random access memory.

The computer programs 34 in the on-vehicle device 4 include, for example, programs that cause the CPU of the processing unit 31 to execute sensing and generation of probe information, route searching for the probe vehicle 3, image processing for displaying a search result on a display of a navigation device, etc.

The communication unit 33 is implemented by a wireless communication device permanently installed in the probe vehicle 3, or a data communication terminal device (e.g., a smartphone, a tablet computer, or a notebook computer) temporarily installed in the probe vehicle 3.

The communication unit 33 has a GPS (Global Positioning System) receiver, for example. The processing unit 31 monitors the present position of the probe vehicle 3 in almost real time, based on GPS position information received by the communication unit 33. Although it is preferable to use, for positioning, a global navigation satellite system such as a GPS, other means may be employed.

The processing unit 31 measures vehicle data such as the vehicle position, the vehicle speed, the vehicle heading, and CAN information of the probe vehicle 3 in every predetermined sensing cycle (e.g., 0.5 to 1.0 seconds), and stores the vehicle data together with the measurement time in the storage unit 12.

When the vehicle data is accumulated for a predetermined recording time (e.g., 5 minutes) in the storage unit 12, the communication unit 33 generates probe information including the accumulated vehicle data and identification information of the probe vehicle 3, and performs uplink transmission of the generated probe information to the information processing device 2.

The on-vehicle device 4 includes an input interface (not shown) that receives input of an operation of a driver. The input interface is implemented by, for example, an input device attached to a navigation device or an input device of a data communication terminal device mounted on the probe vehicle 3.

[Configuration of Central Apparatus]

As shown in FIG. 2, the central apparatus 5 is implemented by a server computer that collectively controls the traffic signal controllers 6 installed at a plurality of intersections included in the traffic control area. The central apparatus 5 includes a processing unit 51, a storage unit 52, a communication unit 53, etc.

The traffic signal controllers 6 in the traffic control area include: point control type first controllers 6A each operating independently (in a stand-alone manner); and second controllers 6B subjected to remote control (traffic adaptive control) by the central apparatus 5.

The processing unit 51 is implemented by an arithmetic processing device including a CPU that reads out computer programs 54 stored in a nonvolatile memory of the storage unit 52, and performs various kinds of information processing according to the programs 54.

The storage unit 52 is a storage device including at least one nonvolatile memory (storage medium) of an HDD and an SSD, and a volatile memory (storage medium) such as a random access memory.

The computer programs 54 in the central apparatus 5 include a program for performing at least one remote control (traffic adaptive control) out of MODERATO, SCOOT, and SCATS.

The processing unit 51 generates a signal control parameter through remote control, and then generates a signal control instruction to be executed by a second controller 6B subjected to remote control.

The signal control instruction is information regarding a light color switching timing of a signal light unit corresponding to a newly generated signal control parameter, and is generated in every control cycle (e.g., 1.0 to 2.5 minutes) of remote control.

The communication unit 53 is implemented by a communication interface that communicates with the information processing device 2 via the public communication network 8, and communicates with the second controller 6B via the dedicated communication line 9. The communication unit 53 may be connected to the information processing device 2 via the dedicated communication line 9.

The communication unit 53 transmits a signal control instruction, which has been generated by the processing unit 51 in every control cycle for the signal control parameter, to the second controller 6B subjected to remote control.

The communication unit 53 transmits, to the information processing device 2, signal information including the cycle length and the red interval length being used by the first and second controllers 6A, 6B. The signal information of the second controller 6B is transmitted to the information processing device 2 in every control cycle (e.g., 1.0 to 2.5 minutes) of remote control.

[Outline and Problem of Conventional Remote Control]

Figure 3:
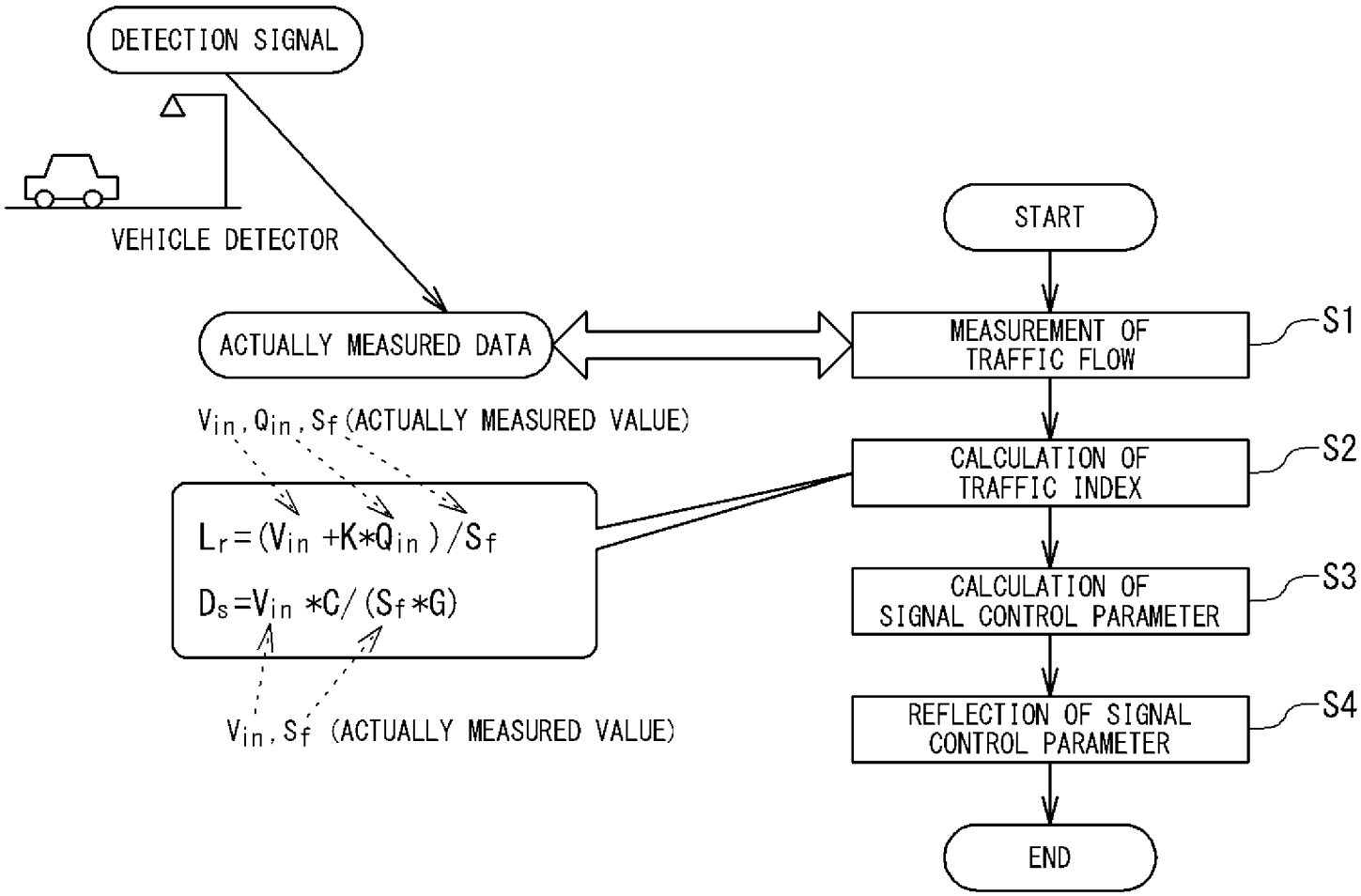
FIG. 3 is a flowchart showing an outline of conventional remote control.

FIG. 3 is a flowchart showing the outline of the conventional remote control (traffic adaptive control).

As shown in FIG. 3, the conventional remote control includes "measurement of traffic flow" (step S1), "calculation of traffic index" (step S2), "calculation of signal control parameter" (step S3), and "reflection of signal control parameter" (step S4).

The processing unit 51 of the central apparatus 5 repeatedly executes each the processes in steps S1 to S4 in every predetermined control cycle (e.g., 1.0 to 2.5 minutes).

Measurement of traffic flow (step S1) is a process of measuring a traffic flow for each inflow road at a target intersection. The conventional measurement of a traffic flow is a process of calculating actually measured data, based on a detection signal (e.g., a pulse signal) from a vehicle detector. The actually measured data includes actually measured values of a traffic volume Vin, the number of queuing vehicles Qin, and a saturation flow rate Sf. Note that Sf may be a set value based on the road structure.

Calculation of traffic index (step S2) is a process of calculating, using the measurement result in step S1, a traffic index, for each inflow road, required for calculating a signal control parameter.

A traffic index used in MODERATO is a load ratio Lr. The load ratio Lr is a ratio of a traffic demand to the maximum traffic volume that can be handled within one cycle. A traffic index used in SCOOT and SCATS is a phase saturation Ds. The phase saturation Ds is a ratio of an arrival traffic volume to the maximum traffic volume that can be handled during a green interval.

A calculation formula for the load ratio Lr is the following formula (1). A calculation formula for the phase saturation Ds is the following formula (2).

$$Lr=(Vin+k\times Qin)/Sf \quad (1)$$

$$Ds=Vin\times C/(Sf\times G) \quad (2)$$

where

Vin: an inflow traffic volume (vehicles/second) to an intersection k: a weighting factor (e.g., 1.0 is used)

Qin: a value obtained by converting the number of queuing vehicles into a traffic volume (vehicles/second)

Sf: a saturation flow rate (vehicles/second)

G: an effective green interval (seconds)

C: a cycle length (seconds)

The calculation formula (1) for the load ratio Lr includes the inflow traffic volume Vin and the number of queuing vehicles Qin, as traffic variables for the inflow road. The calculation formula (2) for the phase saturation Ds includes the inflow traffic volume Vin as a traffic variable for the inflow road.

The processing unit 51 of the central apparatus 5 substitutes the actually measured values of Vin, Qin, and Sf obtained in step S1 into formula (1) or (2) to calculate at least one traffic index out of the load ratio Lr and the phase saturation Ds.

Calculation of signal control parameter (step S3) is a process of calculating signal control parameters such as a split, a cycle length, and the like at the target intersection to be controlled, by using the traffic index calculated in step S2.

Here, a case in which the central apparatus 5 employs MODRERATO and calculates a split and a cycle length at a crossroad intersection including only two phases, is assumed. In addition, the number of each phase is represented by "i" (i=1, 2), and the direction of an inflow road of each phase i is represented by "j" (j=1, 2).

Assuming that the load ratio of each inflow road j in the phase i is "Lij", the traffic volume on the inflow road j is "Vij", the number of queuing vehicles on the inflow road j is "Qij", and the saturation flow rate on the inflow road j is "Sij", the load ratio Lij is represented by the following formula (3).

$$Lij=(Vij+Qij)/Sij \quad (3)$$

The processing unit 51 of the central apparatus 5 calculates a load ratio Lri in the phase i by using the following formula (4), and calculates a load ratio Lrt at the entire intersection by using the following formula (5). In formula (4), "maxj" means the maximum value of j pieces of load ratios Lij included in the phase i.

$$Lri=\max j(Lij) \quad (4)$$

$$Lrt=Lr1+Lr2 \quad (5)$$

Then, the processing unit 51 of the central apparatus 5 calculates a split Xi and a cycle length C in the phase i by using the following formulae (6) and (7). In formula (6), K represents a lost time and a1 to a3 are coefficients.

$$\lambda i=Lri/Lrt \quad (6)$$

$$C=(a1\times K+a2)/(1-a3\times Lrt) \quad (7)$$

Reflection of signal control parameter (step S4) is a process of causing the second controller 6B at the target intersection to implement the signal control parameter calculated in step S3.

Specifically, the processing unit 51 of the central apparatus 5 calculates, from the new signal control parameter, a signal control instruction including a light color switching timing, and transmits the calculated signal control instruction to the second controller 6B. When the second controller 6B can calculate a light color switching timing from the signal control parameter, the processing unit 51 may transmit the signal control parameter as it is to the second controller 6B.

As described above, in the conventional remote control, the actually measured values of Vin, Qin, and Sf obtained from the detection signal of the vehicle detector are substituted into the definition formula (formula (1) or (2)) for the traffic index Lr or Ds to calculate the traffic index Lr or Ds.

Therefore, the conventional remote control has a problem that the control target is limited to the traffic signal controller 6 at an intersection where a vehicle detector is installed. In addition, there is a stereotype that remote control needs a vehicle detector, as long as a load ratio used in MODRERATO and a phase saturation used in SCOOT and SCATS are employed.

Meanwhile, as shown in formulae (1) and (2), each of the definition formulae for the load ratio Lr and the phase saturation Ds includes Vin and Qin in a numerator, and the saturation flow rate Sf in a denominator.

Therefore, when the traffic volume Vin and the number of queuing vehicles Qin to be substituted into formulae (1) and (2) are defined as variables representing ratios to the saturation flow rate Sf, it is possible to calculate the load ratio Lr and the phase saturation Ds even when the true values of Vin, Qin, and Sf are unknown.

That is, when the traffic volume on the inflow road is defined as Vin=α×Sf, the number of queuing vehicles on the inflow road is defined as Qin=β×Sf, and these values are substituted into the formulae (1) and (2), Sf is canceled by numerator/denominator on the right-hand side as shown in the following calculation formulae (8) and (9). This means that, as long as α and β can be determined, the load ratio Lr and the phase saturation Ds can be calculated even when any value is used as the saturation flow rate Sf in the calculation process.

By employing the traffic volume Vin (=α×Sf) normalized by Sf and the number of queuing vehicles Qin (=β×Sf) normalized by Sf, the load ratio Lr and the phase saturation Ds can be calculated even when the values of Vin, Qin, Sf themselves are not determined.

$$Lr = (Vin + k \times Qin)/Sf = (\alpha \times Sf + k \times \beta \times Sf)/Sf = \alpha + k \times \beta \quad (8)$$

$$Ds = Vin \times C/(Sf \times G) = \alpha \times Sf \times C/(Sf \times G) = \alpha \times C/G \quad (9)$$

Hereinafter, the traffic volume Vin (=α×Sf) and the number of queuing vehicles Qin (=β×Sf), each represented by ratios to Sf, are referred to as "normalized traffic volume" and "normalized number of queuing vehicles", respectively. In addition, the "normalized traffic volume" and the "normalized number of queuing vehicles" may be collectively referred to as "normalized data". As described above, the saturation flow rate Sf can take any value.

Meanwhile, the inventor of the present disclosure has found that use of probe information and a calculation result of a traffic simulator allows determination of α and β described above, and allows calculation of signal control parameters from a load ratio Lr and a phase saturation Ds even when no vehicle detector is used, contrary to the aforementioned stereotype.

Figure 5:
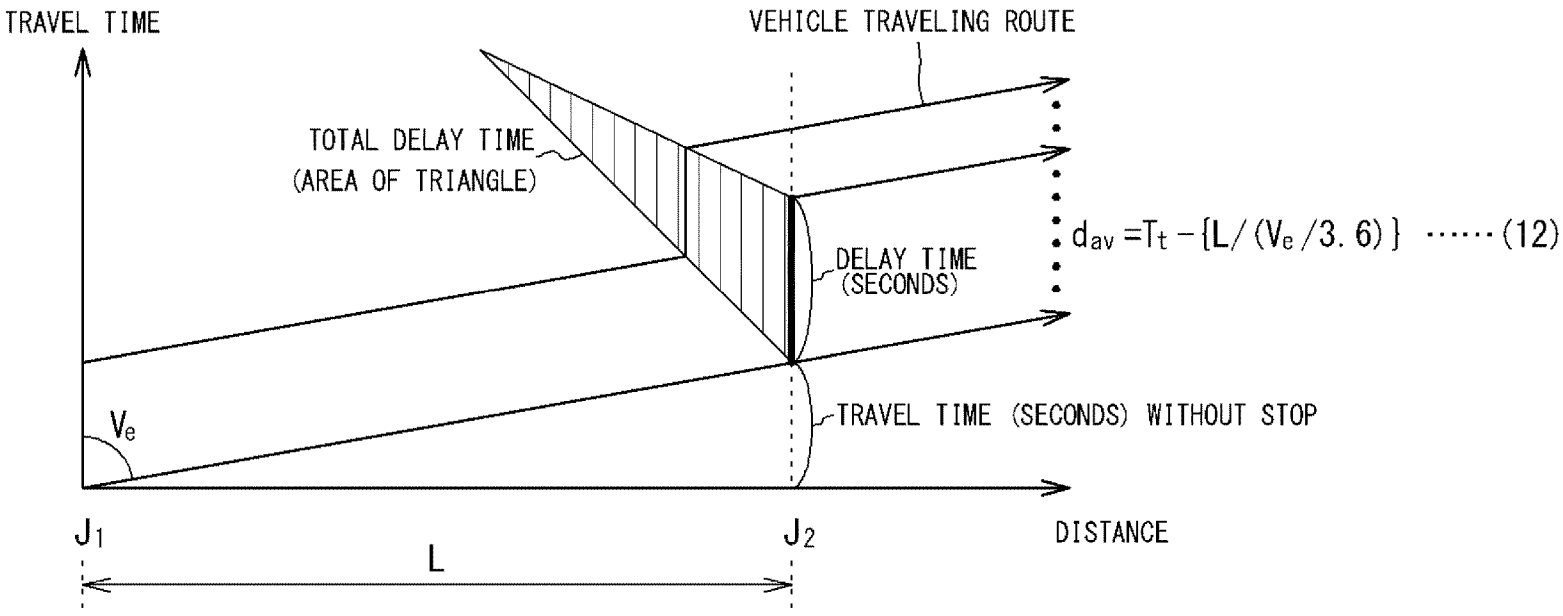
FIG. 5 illustrates an example of a normalized data calculation method in a case where a target intersection subjected to remote control is a stand-alone intersection.

Based on this finding, the present embodiment proposes a method of calculating (including a method of determining), based on probe information or a calculation result of a traffic simulator 15, a normalized traffic volume Vin (=α×Sf) and a normalized number of queuing vehicles Qin (=β×Sf) which are traffic variables, of an inflow road, used for calculation of a traffic index (see FIG. 5 and FIG. 8).

Thus, when the traffic index used for calculation of signal control parameters is calculated by using the normalized data calculated from the probe information or the like, it is possible to execute remote control even when no vehicle detector is installed. Hereinafter, the outline of the remote control of the present embodiment will be described with reference to FIG. 4.

[Outline of Remote Control of Present Embodiment]

Figure 4:
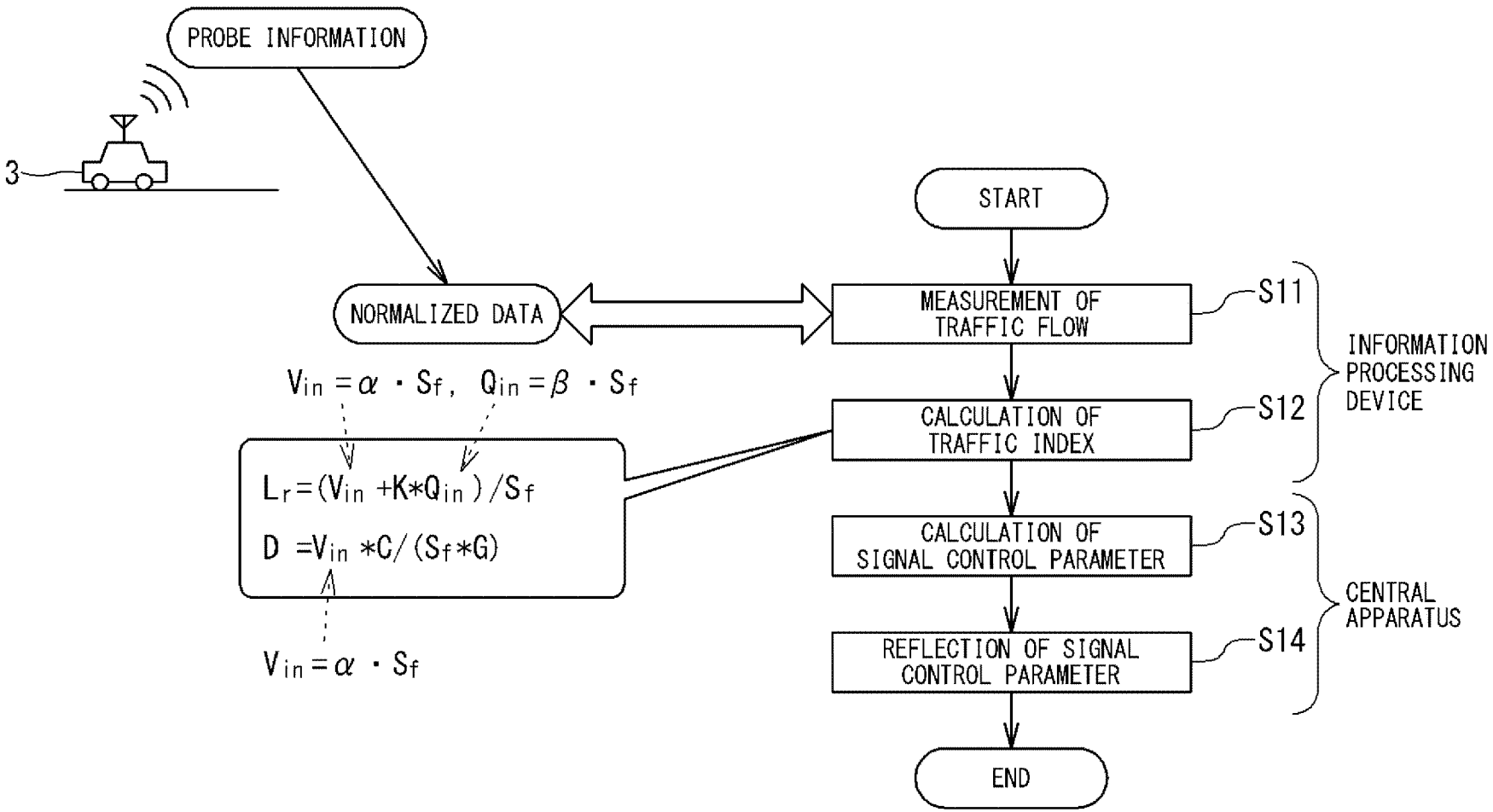
FIG. 4 is a flowchart showing an outline of remote control according to an embodiment of the present disclosure.

FIG. 4 is a flowchart showing the outline of the remote control (traffic adaptive control) of the present embodiment.

As shown in FIG. 4, the remote control of the present embodiment includes "measurement of traffic flow" (step S11), "calculation of traffic index" (step S12), "calculation of signal control parameter" (step S13), and "reflection of signal control parameter" (step S14).

The processing unit 11 of the information processing device 2 repeatedly executes each of the processes in steps S11 and S12 in every predetermined control cycle (e.g., 1.0 to 2.5 minutes).

The processing unit 51 of the central apparatus 5 repeatedly executes each of the processes in steps S13 and S14 in the same control cycle (e.g., 1.0 to 2.5 minutes).

Measurement of traffic flow (step S11) is a process of measuring a traffic flow for each inflow road at a target intersection. Measurement of a traffic flow according to the present embodiment is a process of calculating normalized data, using probe information or a simulation result of the traffic simulator 15 (see FIG. 8) as original data. The normalized data includes a normalized traffic volume Vin (=α×Sf) representing a ratio to Sf, and a normalized number of queuing vehicles Qin (=β×Sf) representing a ratio to Sf.

Calculation of traffic index (step S12) is a process of calculating, using the measurement result in step S11, a traffic index, for each inflow road, required for calculation of a signal control parameter.

A calculation formula for a load ratio Lr is the same as formula (1) described above. A calculation formula for a phase saturation Ds is the same as formula (2) described above.

The processing unit 11 of the information processing device 2 substitutes the normalized data yin (=α×Sf) and Qin (=β×Sf) obtained in step 11 into formula (1) or (2) to calculate at least one traffic index out of the load ratio Lr and the phase saturation Ds.

In this case, as is apparent from formulae (8) and (9) described above, Sf is canceled by numerator/denominator on the right-hand side, and therefore, it is possible to calculate the load ratio Lr and the phase saturation Ds even when the values of Vin, Qin, and Sf themselves are unknown.

The processing unit 11 of the information processing device 2 transmits, to the central apparatus 5, the calculation result of the load ratio Lr or the phase saturation Ds obtained in step S12.

The processing unit 51 of the central apparatus 5 receives the calculation result of the load ratio Lr or the phase saturation Ds from the information processing device 2, and executes the calculation process in steps S13, S14 by using the received calculation result.

Calculation of signal control parameter (step S13) is a process of calculating signal control parameters such as a split and a cycle length of a control target, by using the traffic index received from the information processing device 2. The content of the process in step S13 is the same as that in step S3 shown in FIG. 3.

Reflection of signal control parameter (step S14) is a process of causing the second controller 6B installed at the target intersection to implement the signal control parameters calculated in step S13. The content of the process in step 14 is the same as that in step S4 shown in FIG. 3.

[Calculation Method for Normalized Data Regarding Stand-Alone Intersection]

FIG. 5 illustrates an example of a calculation method for normalized data in a case where a target intersection subjected to remote control is a stand-alone intersection. Meanings of variables and the like shown in FIG. 5 are as follows.

Note that the "stand-alone intersection" is a target intersection that is subjected to remote control and is controlled independently from other intersections.

dav: a delay time (average) (seconds) per vehicle due to waiting at a traffic signal L: a link length (m)

Tt: an average travel time (seconds) of probe vehicles

Ve: an estimated speed (e.g., speed limit) (km/hour)

J1: an intersection located upstream of a target intersection

J2: a target intersection (stand-alone intersection) subjected to remote control As shown in FIG. 5, in the case of remote control for the stand-alone intersection, a normalized traffic volume Vin and a normalized number of queuing vehicles Qin are calculated according to the saturation state (unsaturated/over saturated) of the intersection by using the following formula (10) or (11). In formulae (10) and (11), "R" means a red interval (seconds).

If $dav \leq R/2$ (unsaturated), $$Vin = \{1 - R^2/(2 \times dav \times C)\} \times Sf \quad (10)$$

If $R/2 < dav$ (over saturated), $$Vin = (1 - R/C) \times Sf$$

$$Qin=\{(dav-R/2)/R\}\times(1-R/C)\times Sf \quad (11)$$

Hereinafter, the reason why formulae (10) and (11) are satisfied will be described with reference to FIG. 5 through FIG. 7.

(Relationship Between Link Travel Time and Delay Time)

A graph in the lower stage in FIG. 5 shows a traveling route when a plurality of vehicles travel on the link between the intersections J1 and J2. The horizontal axis of the graph indicates the distance from the intersection J1, and the vertical axis of the graph indicates the travel time.

When a plurality of vehicles travel on the link between the intersections J1 and J2, the delay time dav per vehicle due to waiting at a traffic signal is a value obtained by dividing the total delay time (the area of a triangle) of all the vehicles passing the intersection J2 after a signal change, by the number of the vehicles.

It can be considered that the average travel time Tt of a plurality of probe vehicles 3 includes the aforementioned delay time dav per vehicle.

Therefore, the delay time per vehicle dav due to waiting at the traffic signal is a value obtained by subtracting, from the average travel time Tt of the plurality of probe vehicles 3, a travel time (=L/(Ve/3.6)) in a case of traveling on the link at the estimated speed Ve without waiting at the traffic signal. That is, the delay time dav can be defined by the following formula (12).

$$dav=Tt-\{L/(Ve/3.6)\} \quad (12)$$

The processing unit 11 of the information processing device 2 extracts, from the positions and the times in the probe information included in the probe database 22, probe information of the plurality of probe vehicles 3 having passed the link between the intersections J1 and J2 in the present control cycle.

Then, based on the positions and the times in the extracted probe information, the processing unit 11 calculates the average travel time Tt of the probe vehicles 3, and substitutes the calculated Tt into formula (12) to obtain the delay time dav.

When probe information that apparently indicates stop due to a reason other than waiting at a traffic signal (e.g., probe information with a parking flag) is included, it is preferable to exclude this probe information from the subjects used for calculation of the average travel time Tt.

When probe information that can specify a stop time period due to a reason other than waiting at a traffic signal (e.g., probe information including a parking time period) is included, it is preferable to calculate the average travel time Tt while considering the stop time period.

(Case where Stand-Alone Intersection is Unsaturated)

Figure 6:
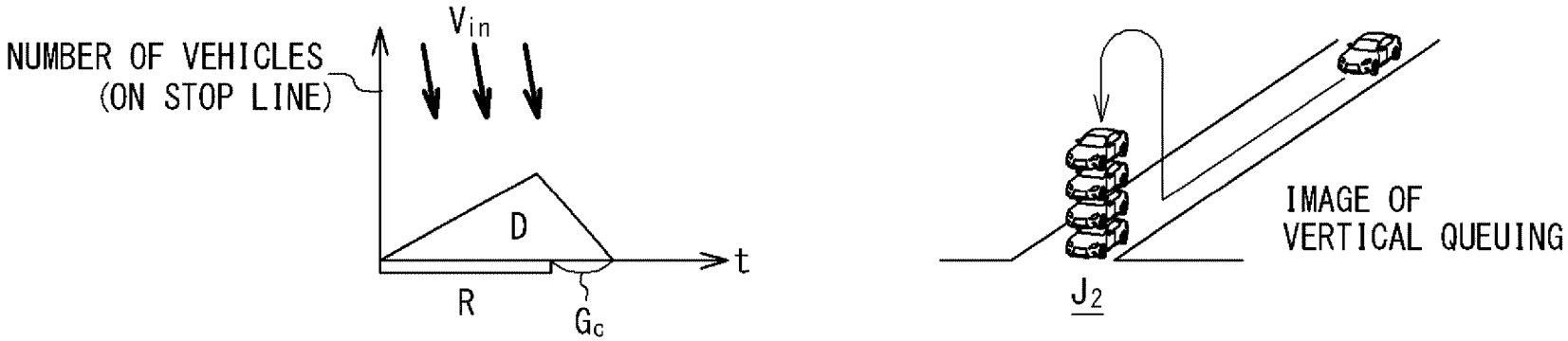
FIG. 6 illustrates a traffic situation at an intersection in an unsaturated state, and relational expressions required for derivation of a traffic volume Vin normalized by Sf.

FIG. 6 illustrates the traffic situation at the intersection J2 in an unsaturated state, and relational expressions required for derivation of a traffic volume Vin normalized by Sf.

In the example shown in FIG. 6, it is premised that vehicles stopping upstream of the intersection J2 are imaginarily stacked at the same position just before a stop line (image of vertical queuing). In FIG. 6, "D" is a total delay time (seconds) within one cycle, and "Gc" is a time (seconds) starting from a green starting time point and represents a time in which a tail-end vehicle passes through the stop line at the intersection J2.

When the inflow road at the intersection J2 is unsaturated (dav≤R/2), the number of vehicles having entered the inflow road after start of red light (=(R+Gc)×Vin) is equal to the number of vehicles having entered the inflow road by the time Gc (=Gc×Sf). Therefore, the stop line passing time Gc of the tail-end vehicle is represented by the following formula (13).

$$Gc=Vin\times R/(Sf-Vin) \quad (13)$$

Calculation formulae for the total delay time D of the vehicle train within one cycle and the delay time dav per vehicle are represented by the following formulae (14) and (15), respectively.

$$D=0.5\times\{(R+Gc)\times R\times Vin\} \quad (14)$$

$$dav=D/(C\times Vin)=0.5\times\{(R+Gc)\times R\}/C \quad (15)$$

By substituting Gc in formula (13) into formula (15) and solving formula (15) for Vin, a calculation formula for the normalized traffic volume Vin in the case where the intersection J2 is in the unsaturated state becomes the aforementioned formula (10).

(Case where Stand-Alone Intersection is Over Saturated)

Figure 7:
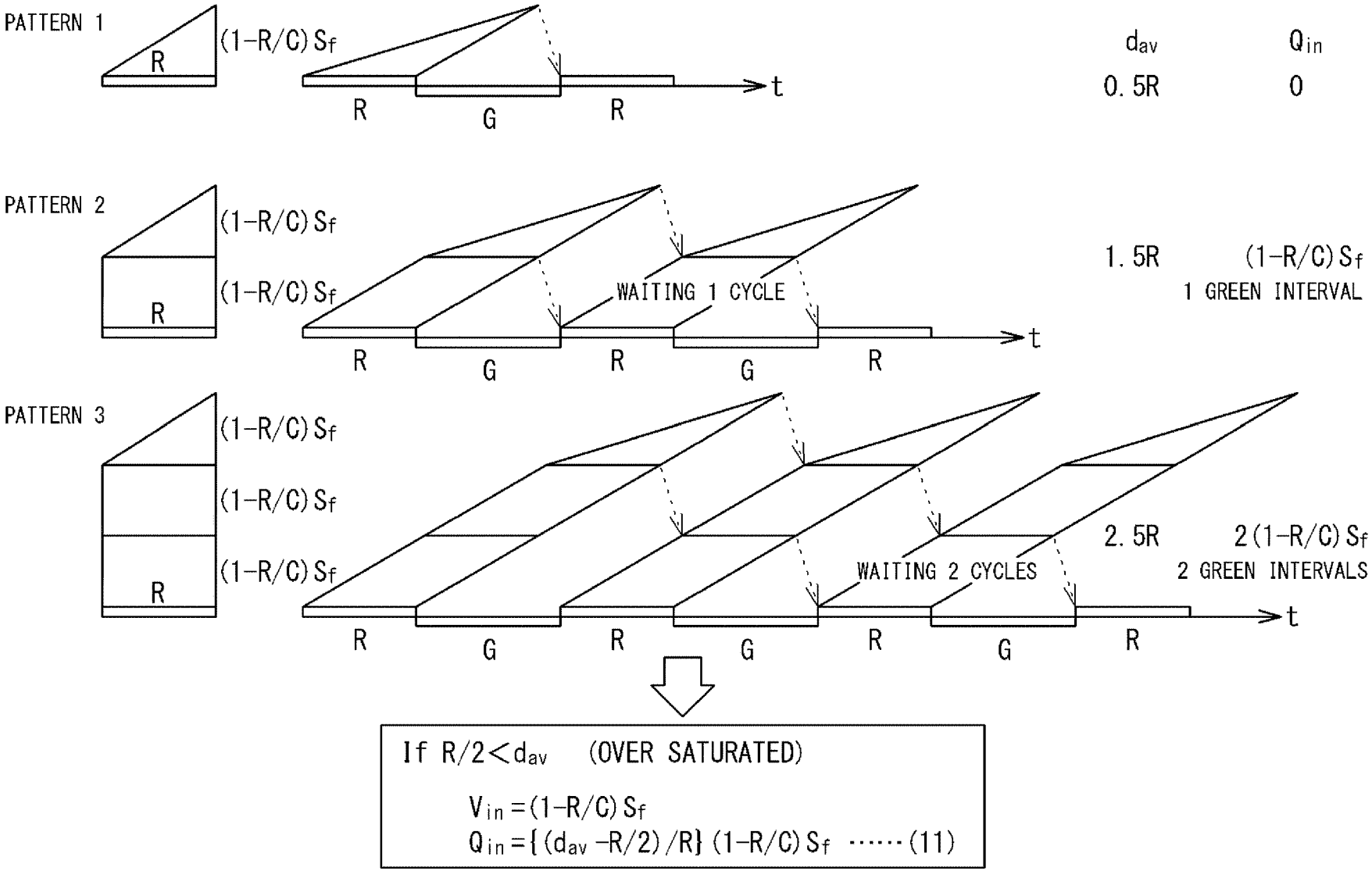
FIG. 7 illustrates an example of a traffic situation at an intersection in an over saturated state.

FIG. 7 illustrates an example of the traffic situation at the intersection J2 in an over saturated state.

As shown in FIG. 7, as a model representing an over saturated state including a vehicle that has waited (stopped) at a traffic signal for two or more cycles, a simple model including only traveling and stopping is assumed. In this case, in the second or later stop of the vehicle at the traffic signal, the stop time period per cycle is equal to the red interval R.

In FIG. 7, a pattern 1 represents a traffic situation where a queue of vehicles has been cleared away during the present cycle (waiting 0 cycle), that is, when the intersection J2 is in the just saturated state.

Meanwhile, in FIG. 7, a pattern 2 represents a traffic situation where a queue of vehicles has been cleared away during the next cycle (waiting 1 cycle), and a pattern 3 indicates a traffic situation where a queue of vehicles has been cleared away during the cycle after the said next cycle (waiting 2 cycles).

In the pattern 1, dav=0.5R, and Qin=0.

In the pattern 2, dav=1.5R, and Qin=(1−R/C)×Sf.

In the pattern 3, dav=2.5R, and Qin=2×(1×R/C)×Sf.

Therefore, a calculation formula for a normalized traffic volume Vin and a normalized number of queuing vehicles Qin when the intersection J2 is in the over saturated state becomes the aforementioned formula (11).

[Calculation Method for Normalized Data Regarding Coordinated Intersection]

FIG. 8 illustrates an example of a calculation method for normalized data in a case where coordinated intersections are target intersections subjected to remote control. Meanings of variables and the like shown in FIG. 8 are as follows.

Note that "coordinated intersections" are a plurality of intersections included in a road section subjected to coordinated control. In the example of FIG. 8, four intersections Ji (i=1 to 4) are coordinated intersections.

dav: a delay time (seconds) per vehicle due to waiting at a traffic signal. However, in the case of the coordinated intersections, dav is a total value of delay times that occur at the intersections J1 to J4 included in a coordinated section.

dsat: a threshold value for determining saturation/unsaturation of each intersection in the coordinated section.

Ri: a red interval at an intersection i

Li: a link length (m) between an intersection i and an intersection i+1

Ofi: an offset (seconds) between Ri and Ri+1

Ve: an estimated speed (e.g., speed limit) (km/hour)

J1: a most upstream intersection in the coordinated section

J2: an intermediate intersection in the coordinated section

J3: an intermediate intersection in the coordinated section

J4: a most downstream intersection in the coordinated section

It is difficult to model a delay time, which is caused by waiting at a traffic signal when a plurality of vehicles travel in the coordinated section, by a simple triangle as shown in the graph at the lower stage in FIG. 5.

Therefore, as for normalized data in the coordinated section, a relationship between a normalized traffic volume Vin and a delay time dav in the coordinated section is simulated by using the traffic simulator 15 having a tool for adjusting an offset in the coordinated section. The computer programs 14 of the information processing device 2 also include a program for causing the processing unit 11 to function as the traffic simulator 15.

Specifically, the traffic simulator 15 causes different numbers of virtual vehicles to be generated on the inflow road at the first intersection J1 in the coordinated section, and calculates a delay time dav for each number of virtual vehicles. The number of virtual vehicles is normalized by Sf, and is increased such that Vin=0.1Sf→0.2Sf→0.3Sf . . . , for example.

Next, the processing unit 11 of the information processing device 2 calculates an average delay time Tr of a plurality of probe vehicles 3 that have actually traveled in the coordinated section (J1 to J4). The threshold value dsat for determining the saturation state (unsaturated/saturated) of the coordinated section is Tr when a saturated state is assumed (0.4Sf in the table). A calculation formula for the delay time Tr (=dsat) in this case is as follows.

$$Tr = \text{average travel time in the coordinated section} - \{\Sigma Li/(Ve/3.6)\}$$

For example, assuming that the delay time Tr (<dsat) obtained from probe information is 114 seconds, the normalized traffic volume Vin corresponding to this is about 0.35×Sf between 0.3×Sf and 0.4×Sf.

As for an unsaturated (dav≤dsat) target intersection among the target intersections J1 to J4, the processing unit 11 of the information processing device 2 sets, as a normalized traffic volume, a traffic volume (=0.35×Sf) corresponding to the actual delay time Tr (<dsat) in the correspondence table 16.

If dav≤dsat (unsaturated),

Vin=traffic volume (e.g., 0.35×Sf) on the correspondence table

As for an over saturated target intersection (intersection J4), i.e., when dsat<dav, the processing unit 11 of the information processing device 2 calculates a traffic volume Vin and a number of queuing vehicles Qin, each representing a ratio to Sf, according to the following formula (16).

If $dsat < dav$ (over saturated)

$$Vin = (1 - R/C) \times Sf$$

$$Qin = \{(dav - dsat)/R\} \times (1 - R/C) \times Sf \quad (16)$$

[Calculation Method for Normalized Data]

Figure 9:
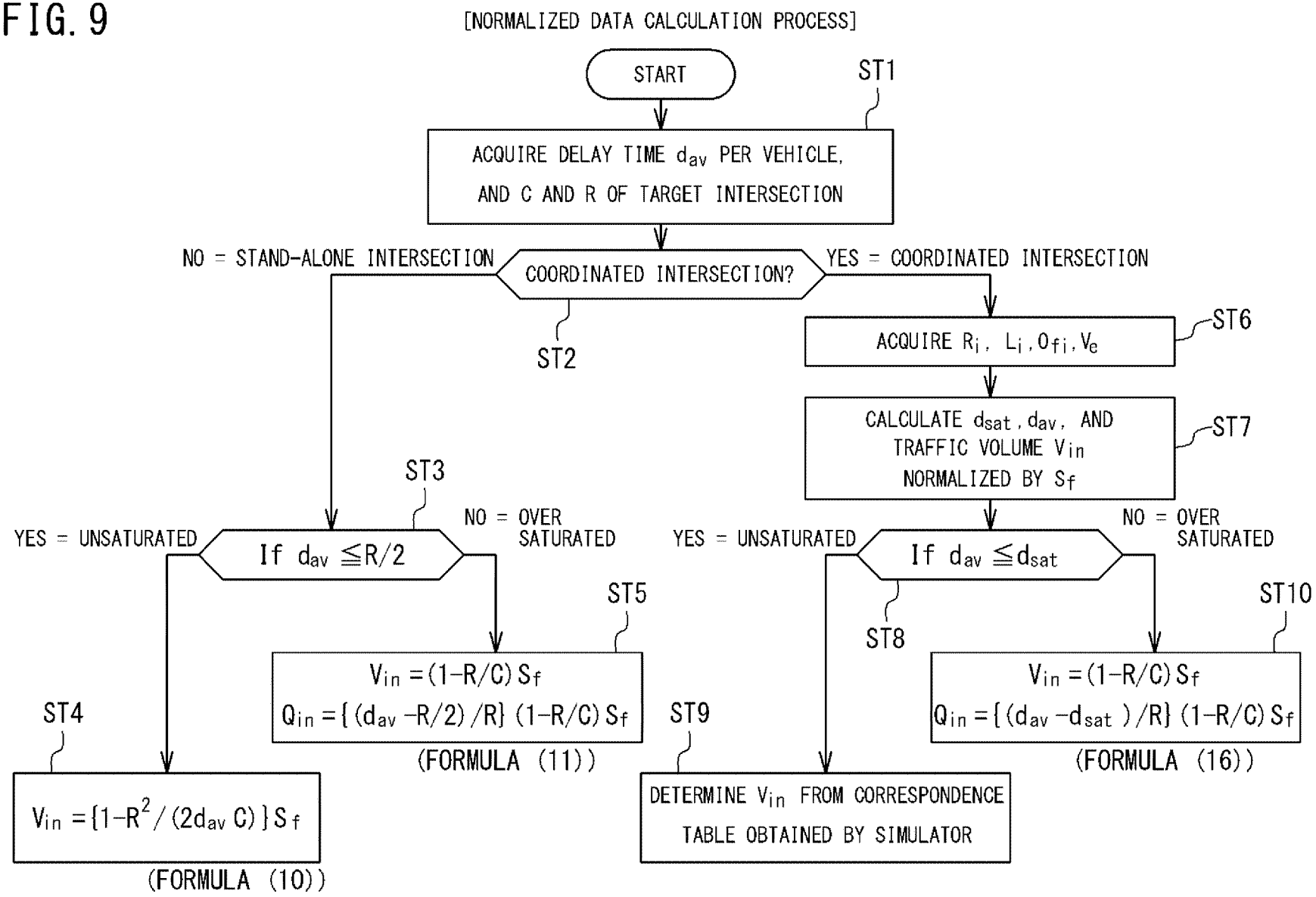
FIG. 9 is a flowchart showing an example of a normalized data calculation process.

FIG. 9 is a flowchart showing an example of a normalized data calculation process executed by the processing unit 11 of the information processing device 2. The processing unit 11 of the information processing device 2 executes the process shown in FIG. 9 for each of inflow roads included in a target intersection.

As shown in FIG. 9, the processing unit 11 of the information processing device 2 firstly acquires a delay time dav per vehicle, and a cycle length C and a red interval R of the target intersection (step ST1).

Specifically, the processing unit 11 calculates the delay time dav by using formula (12), and receives, from the central apparatus 5, the cycle length C and the red interval R of the target intersection at the present time point.

Next, the processing unit 11 determines whether or not the target intersection is a coordinated intersection (step ST2). When the determination result in step ST2 is negative (when the target intersection is a stand-alone intersection), the processing unit 11 determines whether or not dav≤R/2 is satisfied (step ST3).

When the determination result in step ST3 is positive (when the target intersection is unsaturated), the processing unit 11 calculates a traffic volume Vin normalized by Sf, according to the aforementioned formula (10) (step ST4).

When the determination result in step ST3 is negative (when the target intersection is over saturated), the processing unit 11 calculates a traffic volume Vin normalized by Sf and a number of queuing vehicles Qin normalized by Sf, according to the aforementioned formula (11) (step ST5).

When the determination result in step ST2 is positive (when the target intersection is a coordinated intersection), the processing unit 11 acquires Ri, Li, Ofi, and Ve of a plurality of intersections Ji included in a coordinated section (step ST6).

Specifically, the processing unit 11 receives, from the central apparatus 5, Ri, Li, and Ofi of the intersections Ji at the present time point, and reads out a set value of Ve from the storage unit 12.

Meanings of the parameters regarding each intersection Ji in the coordinated section are as follows.

Ri: a red interval (seconds) of an upstream intersection i

Li: a link length (m) between intersections

Ofi: an offset (seconds or percent) indicating a difference in green start time between intersections Ve: a vehicle traveling speed (speed limit or a set value) (k/hour)

dsat: a threshold value (seconds) for determining whether coordinated intersections are saturated or unsaturated Next, the processing unit 11 activates the traffic simulator 15 with the acquired Ri, Li, Ofi, and Ve being input data, and causes the traffic simulator 15 to calculate a traffic volume Vin normalized by Sf, a delay time dav, and a determination threshold value dsat (step ST7).

Next, the processing unit 11 determines whether or not dav≤dsat is satisfied, by using the determination threshold value dsat calculated by the traffic simulator 15 (step ST8).

When the determination result in step ST8 is positive (when the target intersection is unsaturated), the processing unit 11 determines a traffic volume Vin normalized by Sf, based on the correspondence table 16 (see FIG. 8) that summarizes the calculation results of the traffic simulator 15 (step ST9).

When the determination result in step ST8 is negative (when the target intersection is over saturated), the processing unit 11 calculates a traffic volume Vin and a number of queuing vehicles Qin, each normalized by Sf, according to the aforementioned formula (16) (step ST10).

[Effects of Present Embodiment]

According to the present embodiment, the processing unit 11 of the information processing device 2 calculates a traffic volume Vin and a number of queuing vehicles Qin, each being normalized by Sf, and calculates, using the calculation result, a traffic index (load ratio Lr or phase saturation Ds)

to be used for remote control (traffic adaptive control). Therefore, even without actually measured values of the traffic volume Vin and the number of queuing vehicles Qin, the processing unit 11 can calculate the traffic index to be used for remote control.

Consequently, a detection signal from a vehicle detector for measuring the traffic volume Vin and the number of queuing vehicles Qin can be dispensed with, and remote control can be executed even for an intersection where a vehicle detector is not installed.

[First Modification]

While the above embodiment employs the traffic volume Vin and the number of queuing vehicles Qin as normalized data representing ratios to Sf, a traffic demand Dm (vehicles/second) may be employed as normalized data to Sf.

FIG. 10 illustrates an example of an estimation method for a normalized traffic demand Dm.

As shown in FIG. 10, an estimation formula for a traffic demand Dm in an unsaturated state is represented by the following formula (17), and an estimation formula for a traffic demand Dm in an over saturated state is represented by the following formula (18).

$$Dm=Vin/C=\{1-R^2/(2\times dav\times C)\}\times Sf/C \quad (17)$$

$$Dm=\{Qin(t)-Qin(t-1)+(1-R/C)\times Sf\}/C \quad (18)$$

In formulae (17) and (18), the purpose of division by the cycle length C is to convert Vin and Qin calculated per cycle into a value per second.

Calculating the traffic demand Dm based on formulae (17) and (18) allows prediction, by the conventional method, of the effect of improvement of the traffic demand Dm when the signal control parameter is changed. However, a predictable physical value is not an absolute value (vehicles/second) of the traffic demand Dm but a relative value (ratio) to Sf.

[Second Modification]

In the above embodiment, when the number of probe vehicles 3 is small, the average travel time Tt of the probe vehicles 3 is not so accurate, which may result in an inaccurate calculation result of a delay time dav per vehicle due to waiting at a traffic signal (formula (12)).

Therefore, when it is assumed that the average travel time Tt of the probe vehicles 3 is not so accurate, a margin e composed of a standard deviation or the like of the delay time dav may be set and added to the delay time dav per vehicle.

FIG. 11 illustrates a saturation state determination method considering an error in the delay time dav, and an example of a traffic volume calculation formula.

According to the determination method and the calculation formula shown in FIG. 11, since the margin e is added to the delay time dav, a signal control parameter such as a split is calculated a little larger, thereby preventing occurrence of a waiting queue.

In this method, however, a split in a direction in which an assumed error is small (accuracy is high) may be disadvantageously cut. Therefore, for example, a maximum value among margins e regarding all the inflow directions is preferably employed so as to prevent the margin e from becoming advantageous or disadvantageous to a specific direction.

The embodiment (including modifications) disclosed herein is merely illustrative and not restrictive in all aspects. The scope of the present disclosure includes all changes which come within the scope of equivalency of configurations described in the claims.

For example, in the above embodiment, the information processing device 2 may execute measurement of a traffic flow (step S11 in FIG. 4), and the central apparatus 5 may execute calculation of a traffic index and the subsequent processes (steps S12 to S14 in FIG. 4).

When the central apparatus 5 is able to execute collection and analysis of probe information, the central apparatus 5 may perform all the processes from measurement of a traffic flow to reflection of signal control parameters (steps S1*l* to S14 in FIG. 4).

While the margin e is added to the delay time dav in the second modification described above, the delay time dav may be calculated according to the following formula if a delay time dex caused by a reason other than waiting at a traffic signal can be set or acquired, for example.

$$dav=Tt-\{L/(Ve/3.6)\}-dex$$

REFERENCE SIGNS LIST

1 traffic signal control system
2 information processing device (traffic index calculation device)
3 probe vehicle
4 on-vehicle device
5 central apparatus
6 traffic signal controller
6A first controller
6B second controller
3 probe vehicle
7 wireless base station
8 public communication network
9 communication line
10 server computer
11 processing unit (first calculation unit, second calculation unit)
12 storage unit
13 communication unit
14 computer program
15 traffic simulator
16 correspondence table
21 map database
22 probe database
23 member database
24 signal information database
25 road map data
31 processing unit
32 storage unit
33 communication unit
34 computer program
51 processing unit
52 storage unit
53 communication unit
54 computer program

The invention claimed is:

1. A traffic index calculation device configured to calculate a traffic index that is required for calculation of a signal control parameter, the traffic index calculation device comprising:

a processor programmed to:

calculate normalized data representing a ratio of a traffic variable of an inflow road at a target intersection to a saturation flow rate, the normalized data being calculated by using a delay time, which is caused by waiting at a traffic signal, obtained from probe information of a vehicle; and calculate, by using the normalized data, the traffic index that is defined by a formula in which the traffic variable of the inflow road is included in a numerator and the saturation flow rate is included in a denominator.

2. The traffic index calculation device according to claim 1, wherein the processor is programmed to:

calculate the normalized data by using the delay time, and a cycle length and a red interval at the target intersection.

3. The traffic index calculation device according to claim 1, wherein when the target intersection is a stand-alone intersection and the inflow road is in an unsaturated state, the processor is programmed to calculate a normalized traffic volume representing a ratio of a traffic volume on the inflow road to the saturation flow rate, by using a delay time per vehicle, due to waiting at the traffic signal, which is obtained from an average travel time of probe vehicles, and a cycle length and a red interval at the stand-alone intersection.

4. The traffic index calculation device according to claim 3, wherein when the target intersection is the stand-alone intersection and the inflow road is in an over saturated state, the processor is programmed to calculate the normalized traffic volume, and a normalized number of queuing vehicles that represents a ratio of the number of queuing vehicles on the inflow road to the saturation flow rate, by using a delay time per vehicle, due to waiting at the traffic signal, which is obtained from the average travel time of probe vehicles, and the cycle length and the red interval at the stand-alone intersection.

5. The traffic index calculation device according to claim 3, wherein when the target intersection is a coordinated intersection, the processor is programmed to calculate the normalized traffic volume for each of intersections included in a coordinated section, by further using a result of simulation for a traffic flow in the coordinated section, which is executed by a traffic simulator.

6. The traffic index calculation device according to claim 5, wherein when the inflow road at the target intersection is in an over saturated state, the processor is programmed to calculate the normalized traffic volume, and the normalized number of queuing vehicles that represents the ratio of the number of queuing vehicles on the inflow road to the saturation flow rate, by using a threshold value obtained from the result of the simulation with respect to the delay time, and the cycle length and the red interval at the target intersection.

7. The traffic index calculation device according to claim 1, wherein the traffic variable of the inflow road is an inflow traffic volume and the number of queuing vehicles on the inflow road, or the inflow traffic volume on the inflow road.

8. A traffic signal control system comprising:

the traffic index calculation device according to claim 1; and a central server apparatus configured to perform remote control causing a traffic signal controller at the target intersection to operate according to the signal control parameter obtained from the traffic index.

9. A traffic index calculation method for calculating a traffic index that is required for calculation of a signal control parameter, the method comprising:

a first step of calculating normalized data representing a ratio of a traffic variable of an inflow road at a target intersection to a saturation flow rate, the normalized data being calculated by using a delay time, which is caused by waiting at a traffic signal, obtained from probe information of a vehicle; and a second step of calculating, by using the normalized data, the traffic index that is defined by a formula in which the traffic variable of the inflow road is included in a numerator and the saturation flow rate is included in a denominator.

10. A non-transitory computer readable storage medium storing a computer program causing a computer to function as a device for calculating a traffic index that is required for calculation of a signal control parameter, the computer program causing the computer to:

calculate normalized data representing a ratio of a traffic variable of an inflow road at a target intersection to a saturation flow rate, the normalized data being calculated by using a delay time, which is caused by waiting at a traffic signal, obtained from probe information of a vehicle; and calculate, by using the normalized data, the traffic index that is defined by a formula in which the traffic variable of the inflow road is included in a numerator and the saturation flow rate is included in a denominator.

* * * * *